US006103076A

United States Patent [19]

Mizuno

[11] Patent Number: 6,103,076

[45] Date of Patent: Aug. 15, 2000

[54] AUXILIARY ANODE ELEMENT SUITABLE FOR USE IN ELECTROPLATING A BENT TUBULAR WORKPIECE

[75] Inventor: Chikanori Mizuno, Nagoya, Japan

[73] Assignee: Daiwa Excel Co., Ltd., Aichi, Japan

[21] Appl. No.: 09/066,680

[22] Filed: Apr. 28, 1998

[30] Foreign Application Priority Data

Apr. 30, 1997 [JP] Japan ..... 9-112911

[51] Int. Cl.[7] ..... C25D 17/12

[52] U.S. Cl. ..... 204/286; 204/272; 204/280; 204/288; 205/131

[58] Field of Search ..... 205/131; 204/272, 204/280, 286, 288

[56] References Cited

U.S. PATENT DOCUMENTS

| | | | |
|---|---|---|---|
| 2,329,653 | 9/1943 | Rogoff | 16/108 |
| 3,804,725 | 4/1974 | Haynes | 204/26 |
| 4,738,995 | 4/1988 | Kooijmans et al. | 523/404 |
| 4,786,390 | 11/1988 | Lichtenberger et al. | 204/242 |
| 5,527,445 | 6/1996 | Palumbo et al. | 205/103 |
| 5,544,209 | 8/1996 | Michaut | 376/260 |

*Primary Examiner*—Kathryn Gorgos
*Assistant Examiner*—William T. Leader
*Attorney, Agent, or Firm*—Wenderoth, Lind & Ponack, L.L.P.

[57] ABSTRACT

A flexible auxiliary anode element for electroplating a tubular workpiece while the workpiece and an anode element are immersed in a plating liquid contained in a plating both. The flexible auxiliary anode element can be inserted into a hollow interior of the workpiece so that a metal wire of the auxiliary anode element is insulated from an inner peripheral surface of the workpiece by an insulating spacer.

9 Claims, 14 Drawing Sheets

AUXILIARY ANODE ELEMENT SUITABLE FOR USE IN ELECTROPLATING A BENT TUBULAR WORKPIECE

BACKGROUND OF THE INVENTION

1. Field of the Invention

This invention relates to a method of electroplating tubular workpieces and more specifically, an inner surface of a bent tubular workpiece, and an auxiliary anode element suitable for use in the method.

2. Description of the Prior Art

In electroplating, generally, an anode element and a workpiece to be electroplated are immersed in a plating liquid containing plating metal ions. Electric current is supplied between the anode element and the workpiece serving as a cathode element so that the workpiece is electroplated. When the workpiece is tubular, the inside of the workpiece is concealed from the anode element such that a sufficient amount of current flow for the plating is not obtained inside the tubular workpiece. Accordingly, an inner surface of the tubular workpiece has an extremely low degree of plating relative to an outer surface thereof.

To improve non-uniformity in the current flow distribution as described above, the prior art has provided use of an auxiliary anode element. The use of the auxiliary anode element is effective when the tubular workpiece is straightforward in its shape. In this case, the workpiece is placed upright in the plating liquid contained in a plating bath, and the auxiliary anode element is inserted into a hollow interior of the workpiece so as to be concentric therewith. However, the auxiliary anode element has been found ineffective for a bent tubular workpiece which is bent or curved at one or more portions in the middle thereof.

To plate the bent tubular workpiece, the prior art has provided a hot dipping in which the workpiece is immersed in a molten solder with a low melting point etc. to be plated. In this method, however, the solder is as it drops from ends of the workpiece. As a result, the hardened solder projects from the ends of the workpiece and a later mechanical finishing operation is required to remove projections of hardened solder. This complicates the plating process.

SUMMARY OF THE INVENTION

Therefore, an object of the present invention is to provide a method of electroplating in which tubular workpieces and particularly the inner surface of a bent tubular workpiece can sufficiently be electroplated, and an auxiliary anode element suitable for use in the method.

The invention provides a method of electroplating a tubular workpiece comprising the steps of inserting a flexible linear auxiliary anode element into a hollow interior of the workpiece so that the auxiliary anode element is insulated from an inner peripheral surface of the workpiece, immersing the workpiece and the anode element in a plating liquid reserved in a plating bath, and applying voltage between the auxiliary anode element and the workpiece.

An insulating spacer is preferably attached to the auxiliary anode element so that a liquid penetrating space is defined between the auxiliary anode element and the inner peripheral surface of the workpiece. The auxiliary anode element with the insulating spacer attached thereto is preferably inserted into the workpiece.

Since the auxiliary anode element is flexible, the anode element is inserted into the hollow interior of the workpiece, bent according to a shape of the workpiece. Furthermore, since the auxiliary anode element is provided with the insulating spacer, the element is prevented from coming into direct contact with the inner surface of the workpiece. Consequently, since the current distribution is improved inside the workpiece, satisfactory plating can be obtained. Furthermore, since plating defects due to the contact of the auxiliary anode element with the workpiece are eliminated, the inner surface of the workpiece can desirably be electroplated. Additionally, no special aftertreatment as in the conventional plating is required.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENTS

A first embodiment of the present invention will be described with reference to FIGS. 1 to 5. In the first embodiment, the invention is applied to a case in which a filler pipe 1 connected to a gasoline tank inlet of an automobile is galvanized. The filler pipe 1 is made of a steel material and includes an inlet 2, a straightforward portion extending from the inlet 2, and a reduced diameter portion further extending from the straightforward portion. The reduced diameter portion of the filler pipe 1 is bent in its midway at an obtuse angle to one side. The filler pipe 1 is further bent at its distal end approximately at a right angle. A venting auxiliary pipe 3 comprising a small pipe requiring no plating is welded to the inlet 2.

The filler pipe 1 is hung on a hanger 5 further suspended from a circulation line. The hanger 5 will be described in detail later. The filler pipe 1 is conveyed along a line to be treated sequentially at a preparation step including degreasing, cleaning, etc., a galvanizing step as will be described later, and an aftertreatment step including cleaning, chromate treatment, drying, etc. The filler pipe 1 is completed through these treatment steps as a galvanized product.

Figure 2:
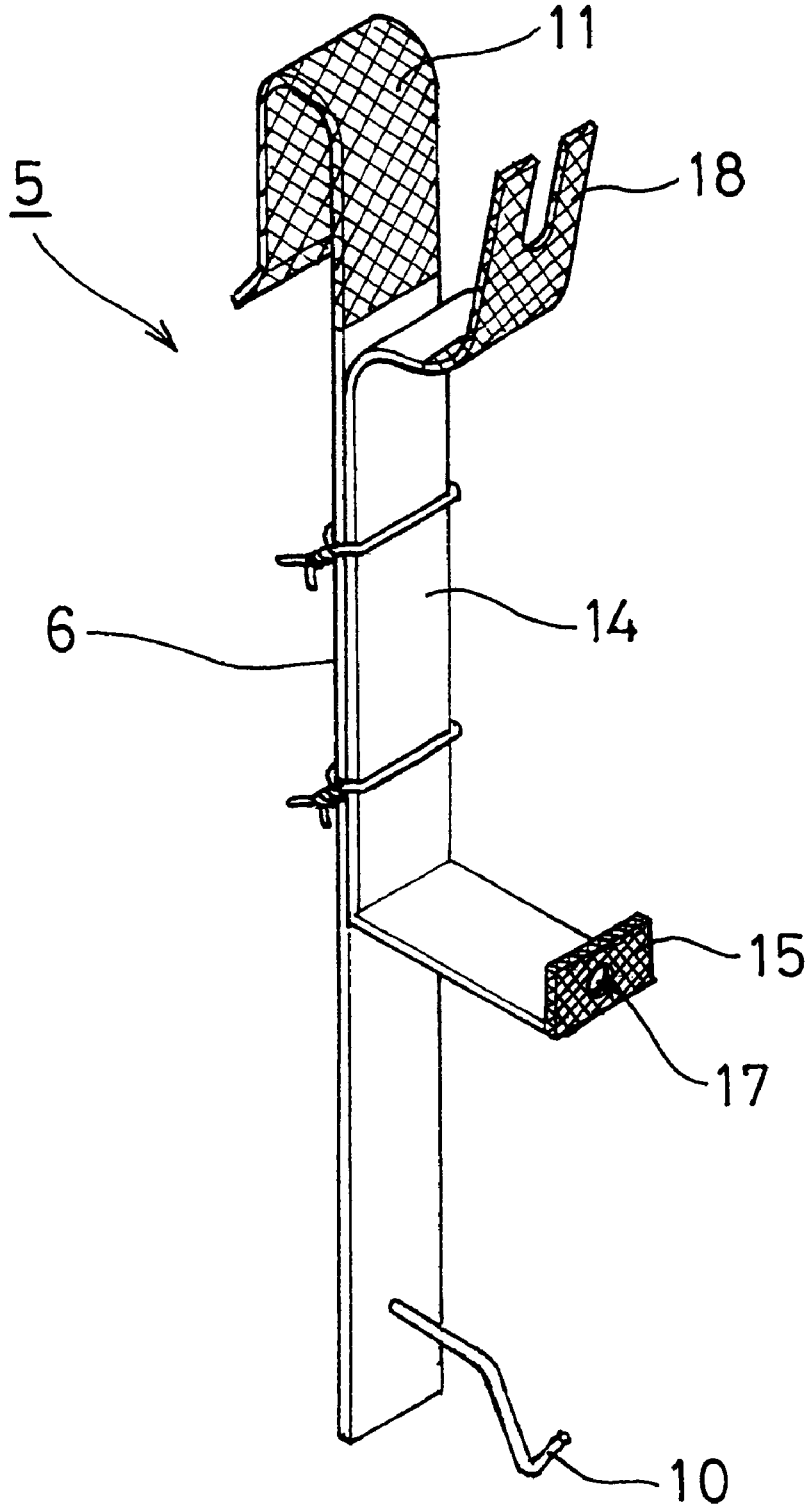
FIG. 2 is a perspective view of a hanger employed in the method.
Figure 3:
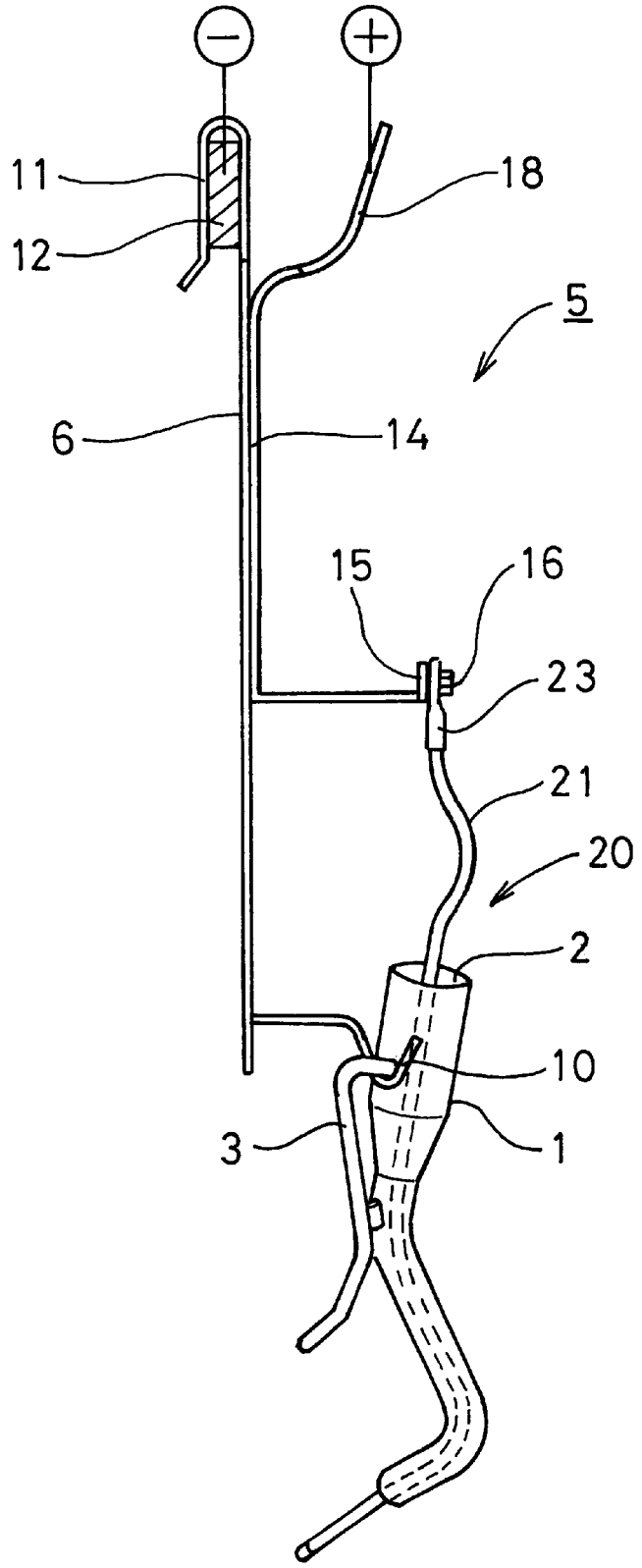
FIG. 3 illustrates a filler pipe suspended from the hanger.

FIGS. 2 and 3 illustrates the above-described hanger 5. The hanger 5 comprises a cathode side frame 6 and an anode side frame 14 integrally assembled together. The filler pipe 1 is hung on the cathode side frame 6. The cathode side frame 6 is made of an electrically conductive metal has a vertically elongated shape. The cathode side frame 6 has a first hook 10 protruding from a lower end thereof and a second hook 11 formed at an upper end thereof. The filler pipe 1 is put on the hook 10. Only the first hook 10 and the second hook 11 (meshed in FIG. 2) of the frame 6 are bared for electrical conduction, and an insulating coating is applied to the remaining portion of the frame 6. A cathode bar 12 is fitted with the second hook 11. The hanger 5 is suspended via the cathode bar 12 from the line.

The anode side frame 14 is provided for hanging an auxiliary anode element 20 as will be described later. The anode side frame 14 is also made of the conductive metal. The anode side frame 14 has a bent mount 15 provided at a lower end thereof. The mount 15 has a screw hole 17 with which a bolt 16 is threadingly engageable. The mount 15 further has an obliquely projecting contact piece 18 formed at an upper end thereof. Only the mount 15 and the contact piece 18 of the anode side frame 14 are bared for electrical conduction as shown in meshes in FIG. 2, and an insulating coating is applied to the remaining portion of the frame 14. The cathode side frame 6 and the anode side frame 14 are bound back to back by wires so as to be integrally assembled together to be insulated from each other.

Figure 4:
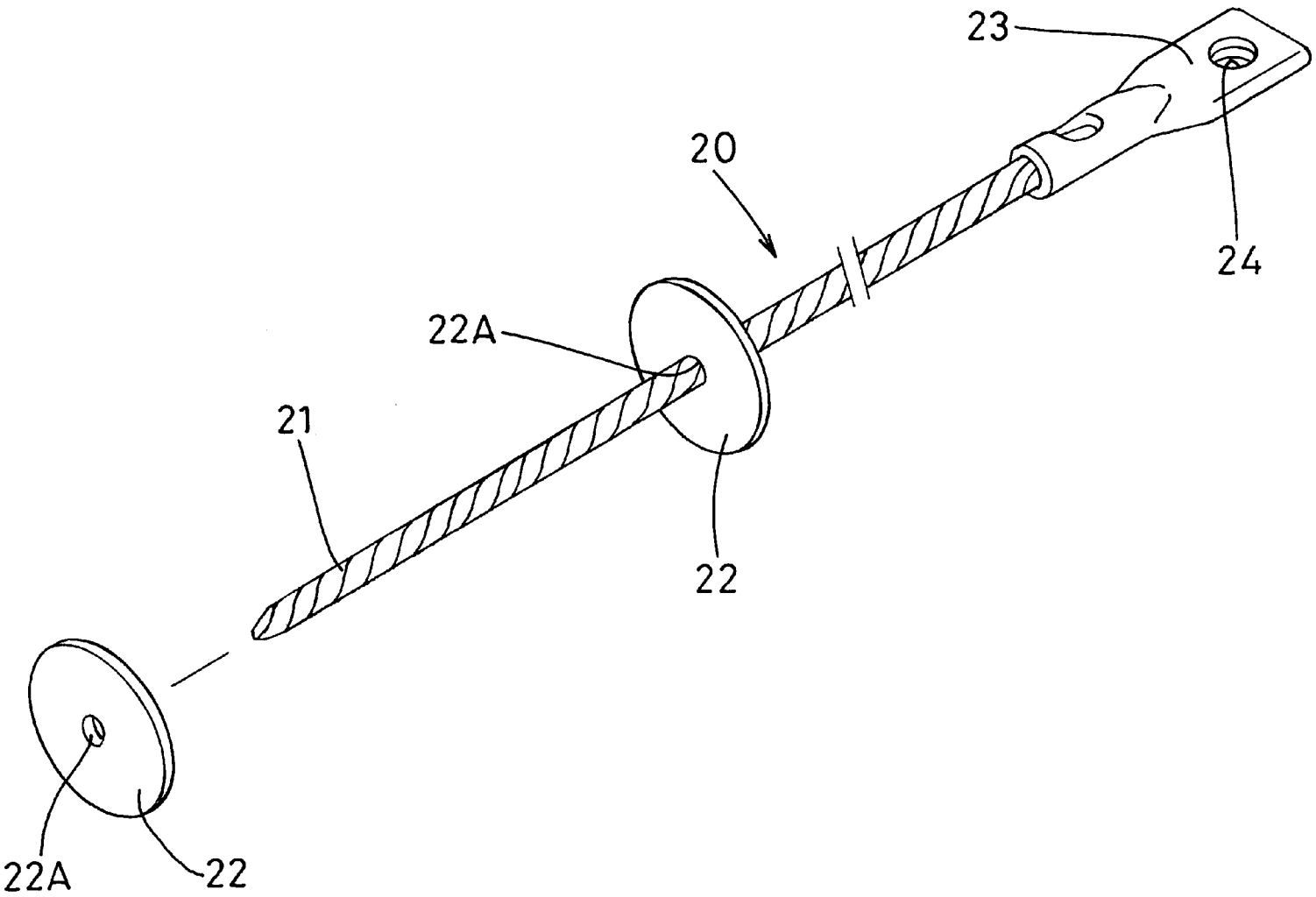
FIG. 4 is a partially cut away perspective view of an auxiliary anode element.

The auxiliary anode element 20 will now be described. As shown in FIG. 4, the auxiliary anode 20 comprises a metal wire 21 and an insulating spacer 22. The metal wire 21 is formed by stranding a number of stainless steel wires and has flexibility. The metal wire 21 is inserted into a hollow interior of the filler pipe 1 with a clearance between it and the inner circumference of the pipe. A terminal member 23 is secured to an end of the metal wire 21. The terminal member 23 has an insertion hole 24 for the bolt 16.

The insulating spacer 22 is made of a non-conductive material such as synthetic resin and has the shape of a disk having a central through hole 22A. The metal wire 21 is inserted through the central hole 22A so that the insulating spacer 22 is fitted with the metal wire 21.

Figure 1:
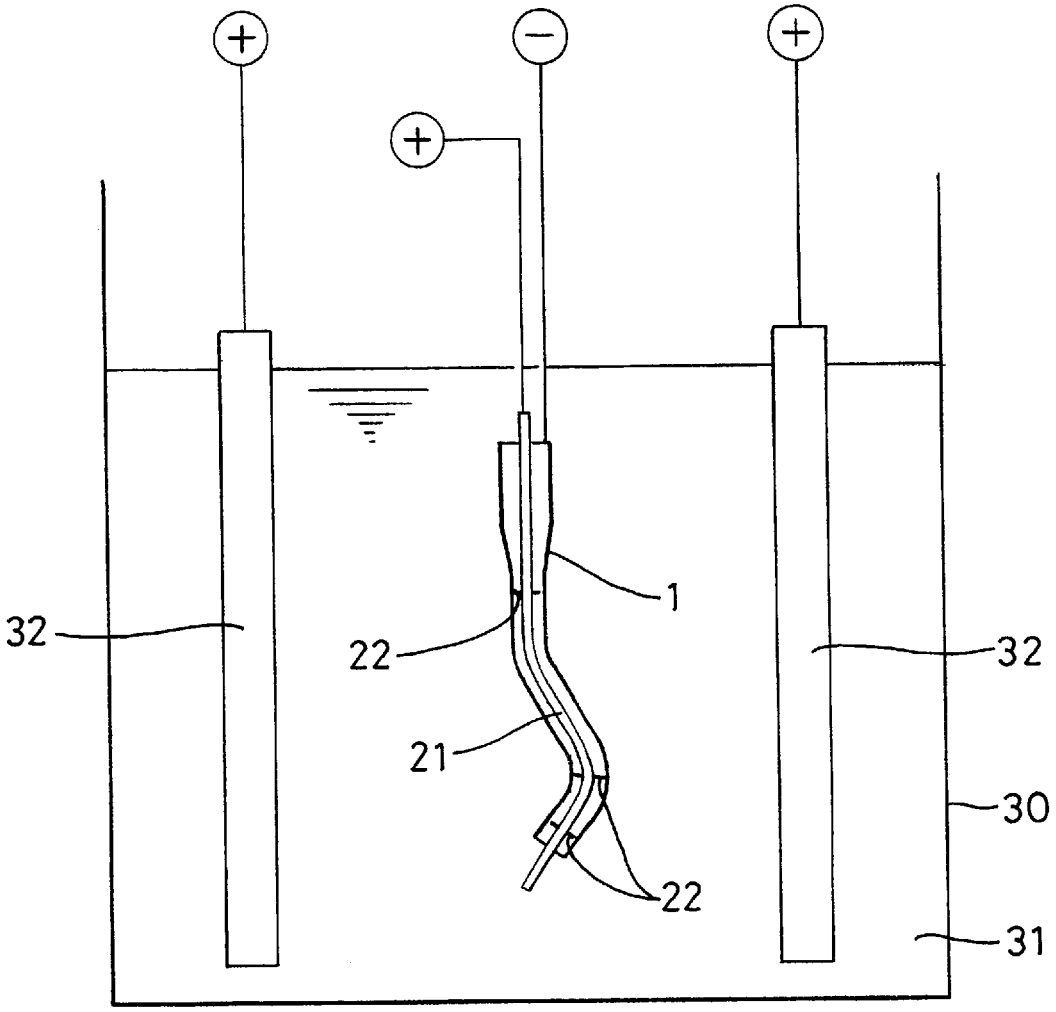
FIG. 1 is a schematic longitudinal sectional view of a plating bath employed in the method of a first embodiment in accordance with the present invention.

A plating bath 30 is provided at the galvanizing step as shown in FIG. 1. A predetermined amount of plating liquid 31 is held or reserved in the plating bath 30. The plating liquid 31 contains 20 g/l of zinc (Zn), 60 g/l of sodium hydroxide (NaOH), and 50 g/l of sodium cyanide (NaCN). The temperature of the plating liquid 31 is maintained in a range between 25 and 30° C. (cyanic bath). The plating liquid may be a zincate bath which does not contain sodium cyanide.

Two zinc plates 32 are hung down at opposite sides in the plating bath 30 so as to be immersed in the plating liquid 31. The zinc plates 32 are connected to anodes of a power supply system (not shown), respectively. The hanger 5 on which the filler pipe 1 is mounted is immersed in the plating liquid 31 in the central interior of the plating bath 30. When the hanger 5 is immersed in the plating liquid 31 in the plating bath 30, the cathode bar 12 connected to the cathode side frame 6 is conductively connected to the cathode of the power supply system. The anode side frame 14 is conductively connected via the contact piece 18 to an anode of the power supply system.

Figure 5:
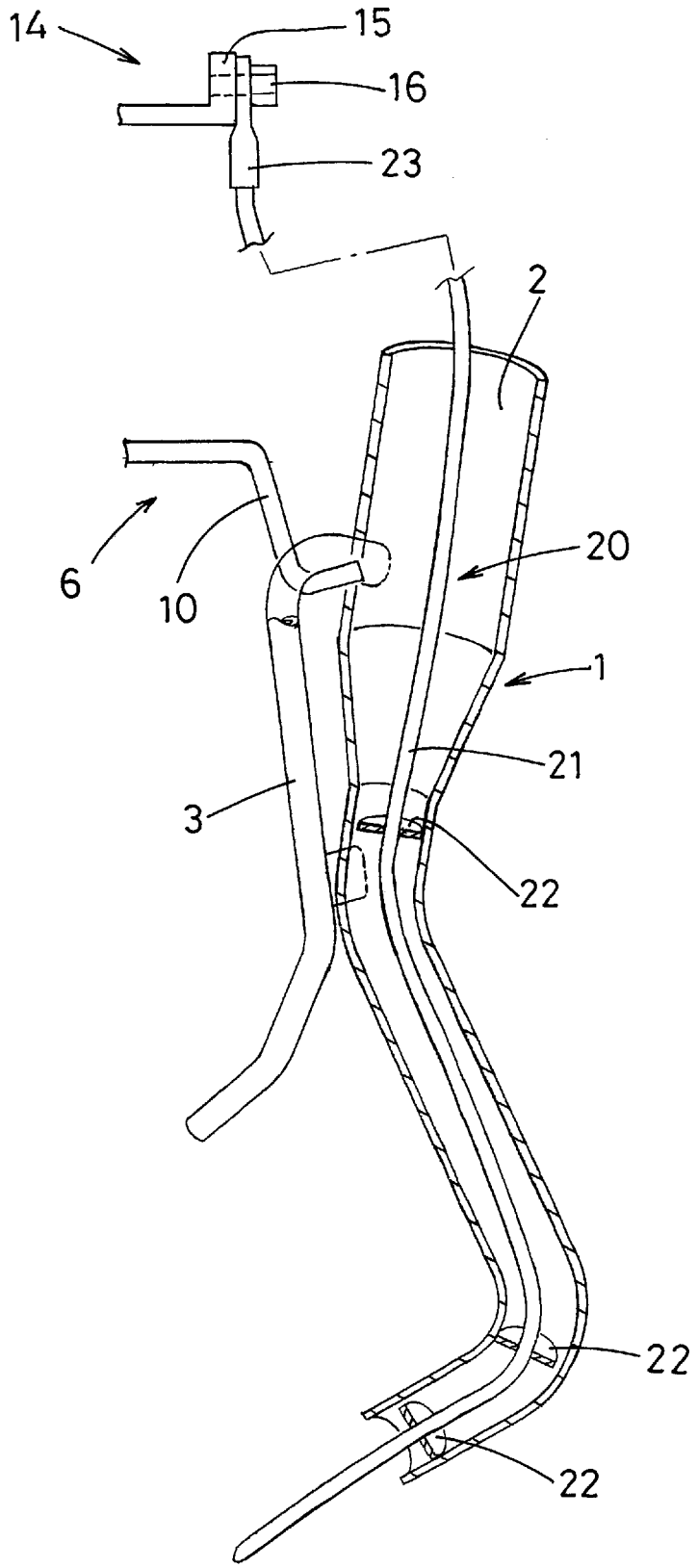
FIG. 5 is a sectional view of the filler pipe into which the auxiliary anode element is inserted.

In execution of the galvanization process, the terminal member 23 of the metal wire 21 is conductively fixed to the mount 15 of the anode side frame 14 by the bolt 16 as shown in FIG. 3. A suitable number of the insulating spacers 22 are then fitted with the periphery of the metal wire 21. As a result, the auxiliary anode element 20 is hung on the anode side frame 14. The filler pipe 1 is racked by the hanger 5 at a predetermined racking position. In this case, a free end of the auxiliary anode element 20 is first inserted through the inlet 2 into the filler pipe 1. Then, the flexible metal wire 21, which is bent according to the bent form of the filler pipe 1, is inserted with the insulating spacers 22 being fitted with the filler pipe at predetermined positions, as shown in FIG. 5. Consequently, the metal wire 21 is inserted in the filler pipe 1 approximately at the center of the hollow interior of the pipe without making contact with the inner surface of the pipe.

The auxiliary pipe 3 is then hung on the first hook 10 such that the filler pipe 1 is suspended from the hanger 5. When two filler pipes 1 are to be suspended in a vertical alignment, a single longer auxiliary anode element is provided so that the auxiliary anode element is inserted into both filler pipes 1.

Upon completion of the racking, the filler pipe 1 suspended from the hanger 5 is carried along the line so that the above-described preparation steps including degreasing, cleaning, etc. are sequentially executed. Upon completion of the preparation steps, the filler pipe 1 is transferred to the galvanizing step. The filler pipe 1, suspended from the hanger 5, is immersed in the plating liquid 31 contained in the plating bath 30. The cathode bar 12 connected to the cathode side frame 6 is further connected to the cathode of the power supply system, whereas the anode side frame 1 is connected via the contact piece 18 to the anode of the power supply system. As a result, an electric current is caused to flow from the zinc plates 32 and the metal wire 21 both connected to the anode to the filler pipe 1 connected to the cathode, whereupon the outer and inner surfaces of the filler pipe 1 is galvanized. The galvanizing step is executed for twenty and several minutes.

Upon completion of the galvanizing step, the above-described aftertreatment step including cleaning, chromate processing, drying, etc. are sequentially executed for the filler pipe 1. The filler pipe 1 is completed through these steps as a galvanized product.

According to the foregoing embodiment, the auxiliary anode element 20 is inserted into the filler pipe 1 when the filler pipe 1 having the vent portions is galvanized. Consequently, the inner surface of the filler pipe 1 can sufficiently be galvanized as well as the outer surface thereof. More specifically, since the metal wire 21 is flexible, the metal wire, bent according to the bent form of the filler pipe 1, is inserted into the filler pipe 1. Furthermore, since the insulating spacers 22 are fitted with the filler pipe 1, the metal wire 21 can be prevented from coming into direct contact with the inner surface of the filler pipe.

Consequently, the current flow distribution in the hollow interior of the filler pipe 1 is improved such that a sufficient plating (plated coating) thickness can be obtained. Furthermore, the inner surface of the filler pipe 1 can sufficiently be galvanized without non-plated portions due to the contact of the metal wire 21 with the inner surface of the filler pipe 1. The inventor of the present invention has confirmed that the same coating thickness by the plating can be obtained on the inner surface of the filler pipe as on the outer surface thereof. Additionally, since no later mechanical finishing as necessitated in the conventional hot dipping is required, the manufacturing step of the filler pipe can be simplified and accordingly, the manufacturing cost thereof can be reduced.

Figure 6:
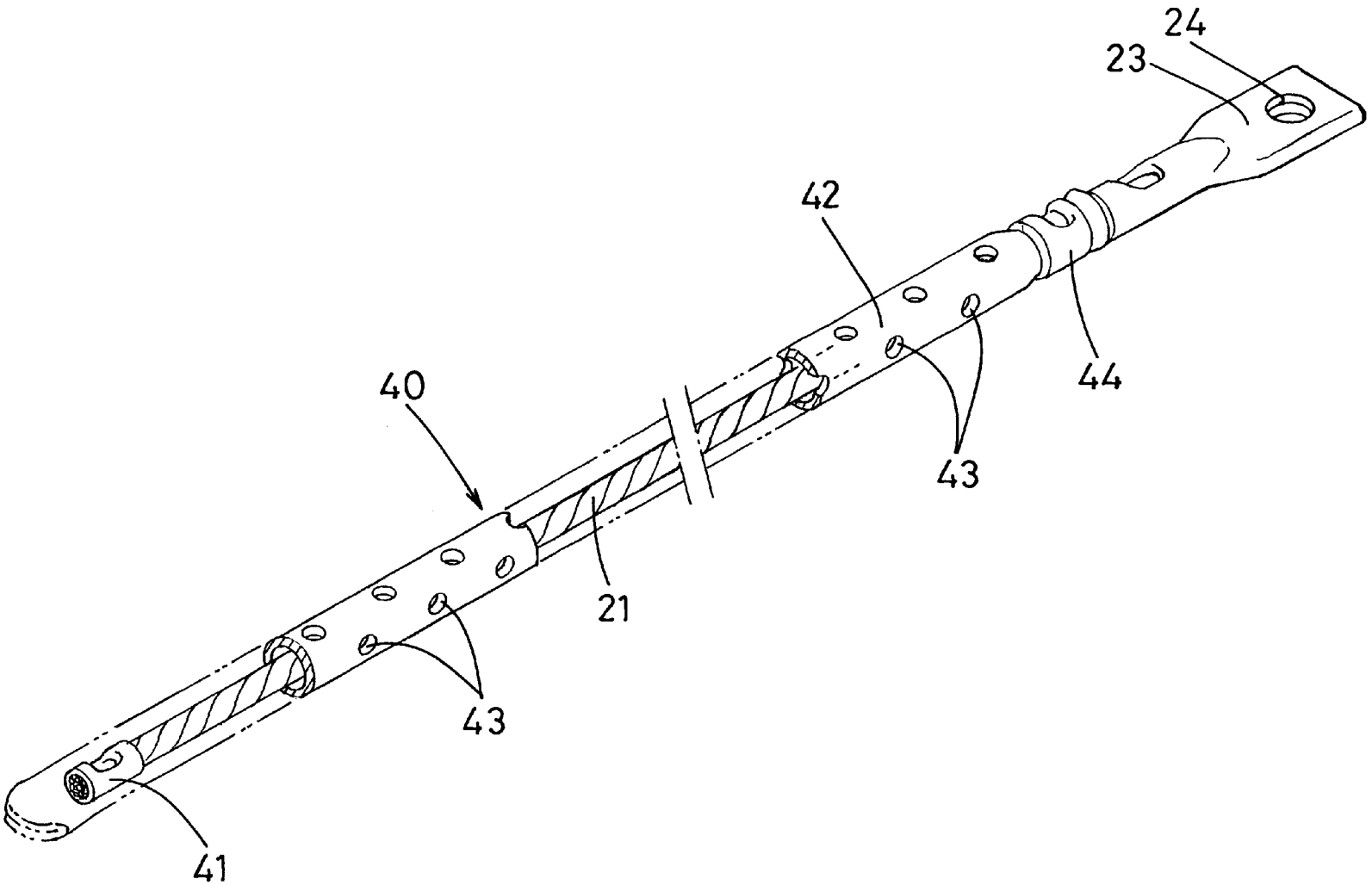
FIG. 6 is a partially cut away perspective view of the auxiliary anode element employed in the method of a second embodiment.
Figure 7:
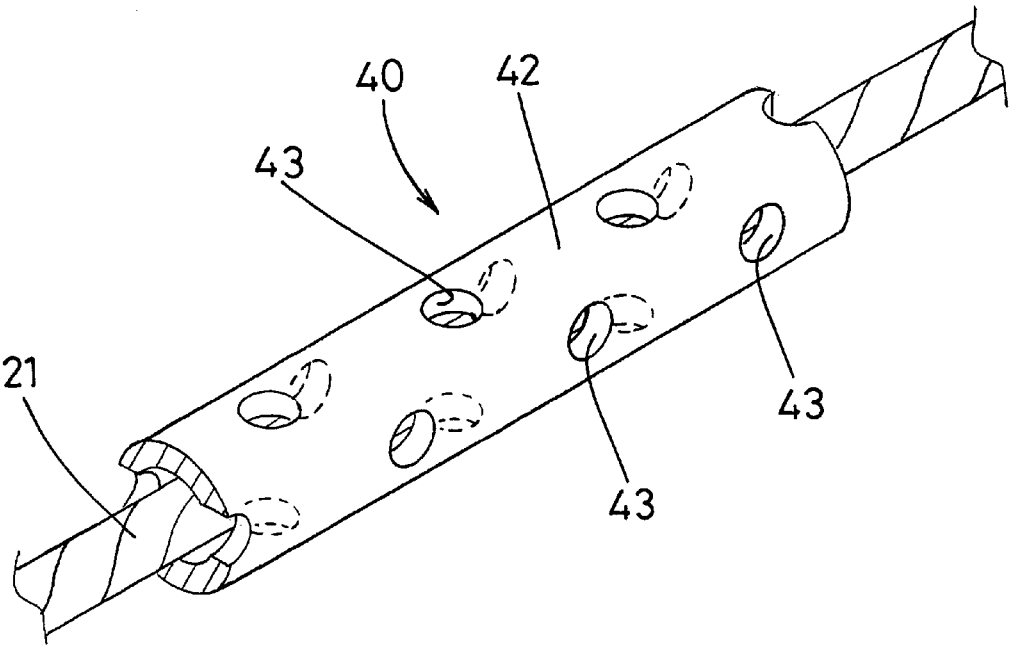
FIG. 7 is a partially enlarged perspective view of the auxiliary anode element.
Figure 8:
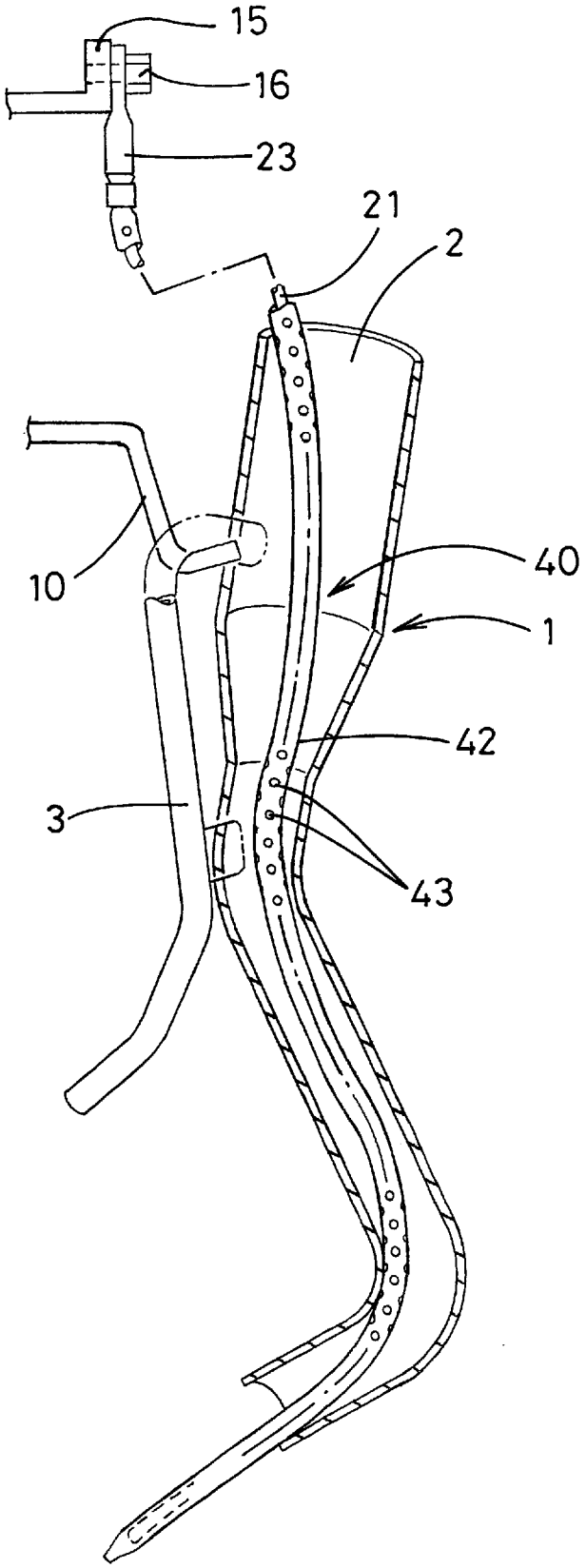
FIG. 8 is a sectional view of the filler pipe into which the auxiliary anode element is inserted, in the second embodiment.

FIGS. 6 to 8 illustrate a second embodiment of the invention. The second embodiment relates to an improvement in the auxiliary anode element. An auxiliary anode element 40 used in the second embodiment is constituted as shown in FIG. 6. More specifically, the auxiliary anode element 40 includes the same metal wire as that of the element 20 in the first embodiment. A cylindrical member 41 is secured to the distal end of the metal wire 21 to collect the stainless steel wires thereof together. A vinyl tube 42 constitutes the spacer in the second embodiment. The vinyl tube 42 has a number of openings 43 formed in a circumferential face thereof in lines. The metal wire 21 is fitted in the vinyl tube 42. The vinyl tube 42 is fixed to an attachment structure 44 at one end side of the metal wire 21, whereas it is crushed at the other end side of the metal wire 21 to be melted.

When the auxiliary anode element 40 is inserted into the filler pipe 1, the metal wire 21 is bent together with the vinyl tube 42, according to the bent form of the filler pipe 1, and is inserted into the filler pipe 1, as shown in FIG. 8. The vinyl tube 42 is partially brought into contact with the inner surface of the filler pipe 1 and accordingly, the metal wire 21 is prevented from directly contacting the inner surface of the filler pipe 1.

The current flow distribution in the hollow interior of the filler pipe 1 is also improved when the filler pipe 1 is galvanized using the auxiliary anode element 40. Consequently, a sufficient coating thickness by the galvanization can be obtained. Furthermore, the inner surface of the filler pipe 1 can also be galvanized sufficiently without non-plated portions due to the contact of the metal wire 21 with the inner surface of the filler pipe 1. Additionally, since the auxiliary anode element 40 has almost no portions which can be caught, it can smoothly be inserted into the filler pipe 1.

Figure 9:
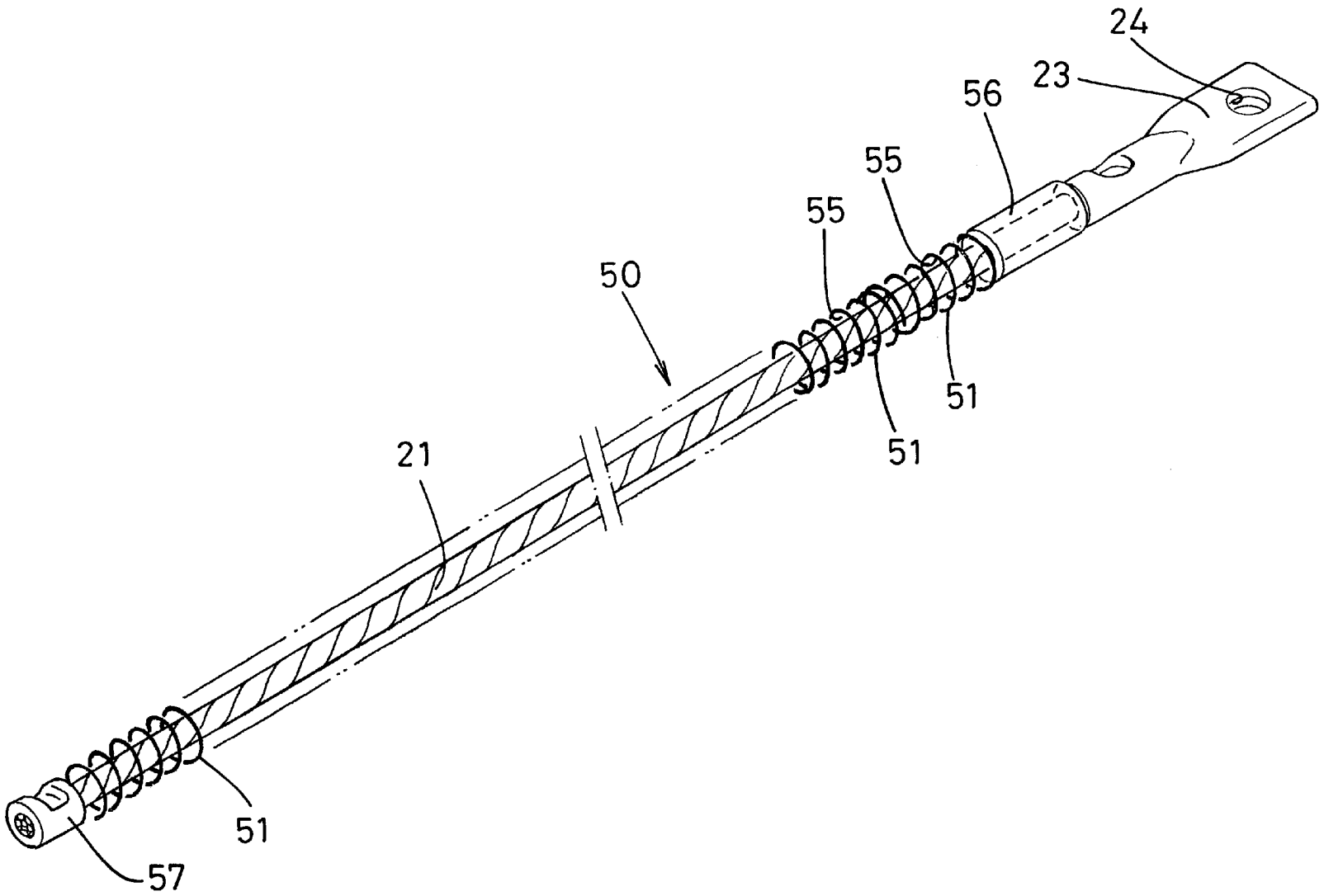
FIG. 9 is a partially cut away perspective view of the auxiliary anode element employed in the method of a third embodiment.
Figure 10:
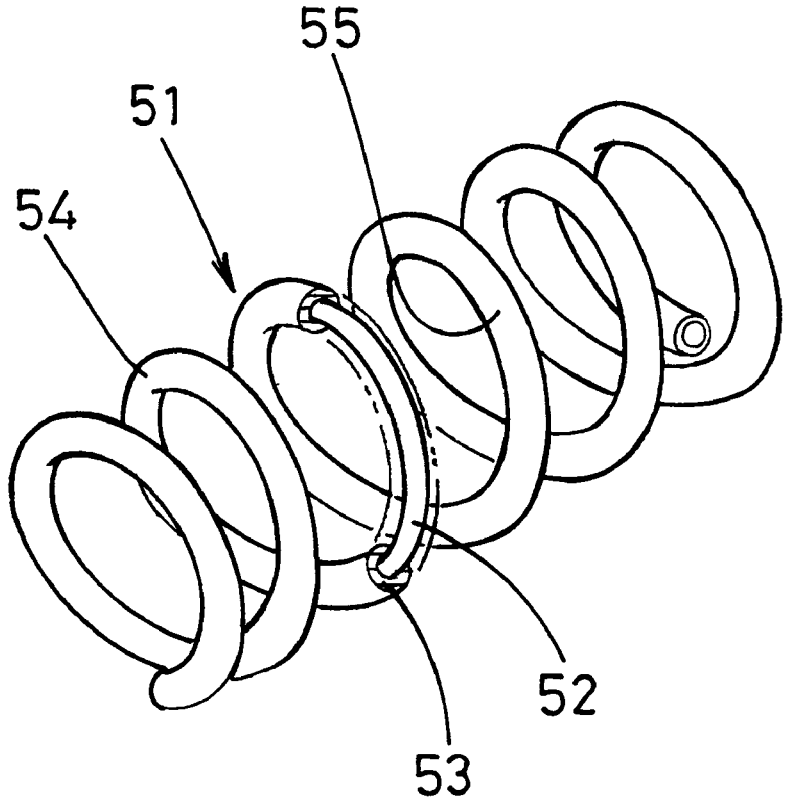
FIG. 10 is a partially cut away perspective view of a coil constituting the insulating spacer.
Figure 11:
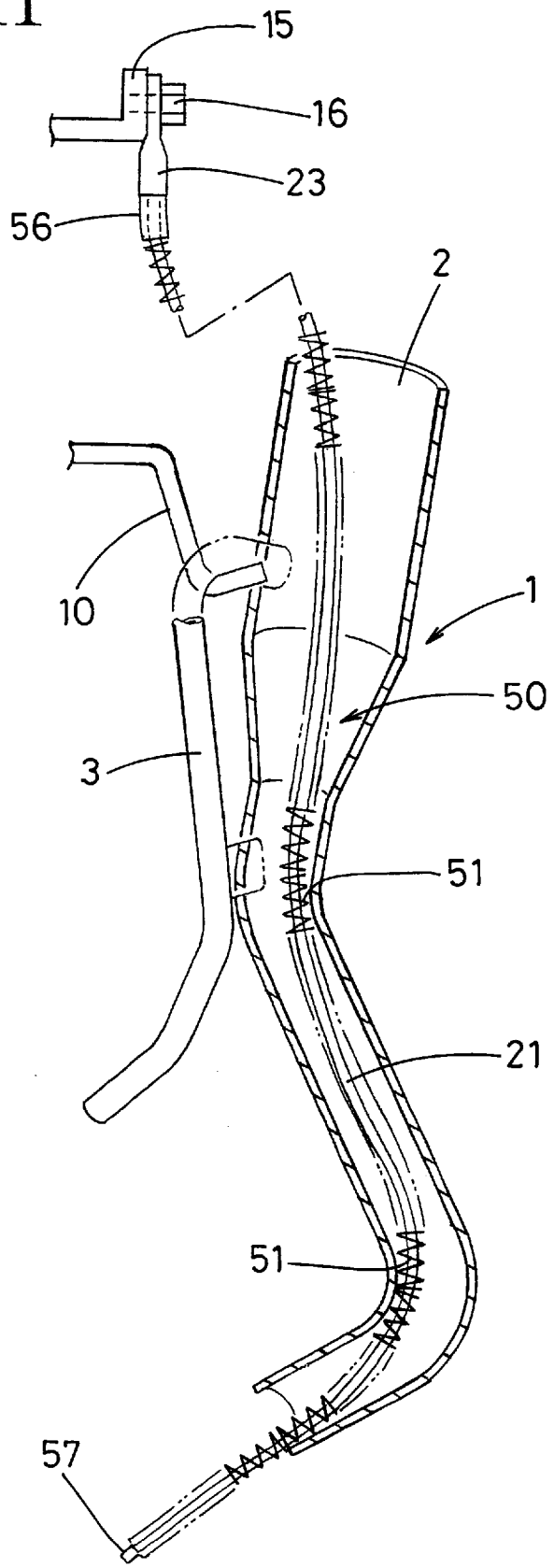
FIG. 11 is a sectional view of the filler pipe into which the auxiliary anode element is inserted, in the third embodiment.

FIGS. 9 to 11 illustrate a third embodiment of the invention. An auxiliary anode element 50 includes a spacer comprising a plurality of coils 51 in the third embodiment. Each coil 51 is made of a base material or a wire material 54 as shown in FIG. 10. The wire material 54 is formed by covering a steel wire 52 with a resin tube 53. The wire material 54 is then wound helically into a cylindrical shape with a predetermined length. Since the wire material 54 is covered with an insulating sheath, each coil 51 is electrically non-conductive. Furthermore, an opening is formed between each turn of the wire material 54 and the adjacent one.

A cylindrical cushion member 56 with elasticity is fitted with the proximal end of the metal wire 21. Thereafter, a plurality of coils 51 are sequentially fitted with the metal wire 21. A stopper 57 is finally fastened to the distal end of the metal wire 21 for preventing the coils 51 from falling off. Thus, the auxiliary anode element 50 is constituted including the coils 51 continuously fitted with the metal wire 21 as shown in FIG. 9. When the auxiliary anode element 50 is inserted into the filler pipe 1, the metal wire 21 is suitably curved between the coils to be bent according to the bent form of the filler pipe 1, as shown in FIG. 11. The coils 51 are partially brought into contact with the inner surface of the filler pipe 1 and accordingly, the metal wire 21 is prevented from directly contacting the inner surface of the filler pipe 1.

The current flow distribution in the hollow interior of the filler pipe 1 is improved as in the first embodiment. Consequently, a sufficient coating thickness by the galvanization process can be obtained. Furthermore, the inner surface of the filler pipe 1 can also be galvanized sufficiently without non-plated portions due to the contact of the metal wire 21 with the inner surface of the filler pipe 1. The auxiliary anode element 50 is particularly suitable in the case where the filler pipe 1 has a small diameter.

Figure 12:
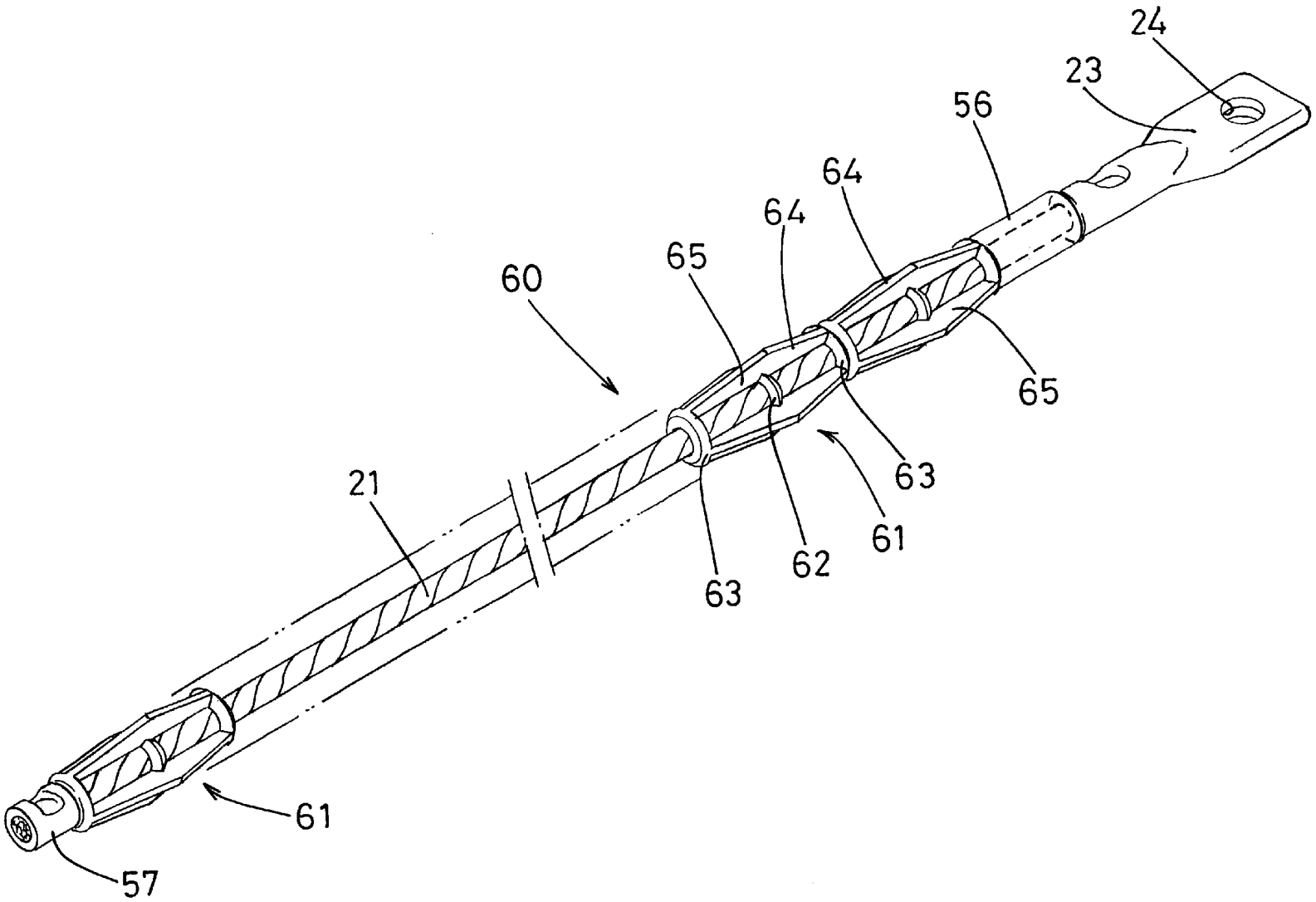
FIG. 12 is a partially cut away perspective view of the auxiliary anode element employed in the method of a fourth embodiment.
Figure 13:
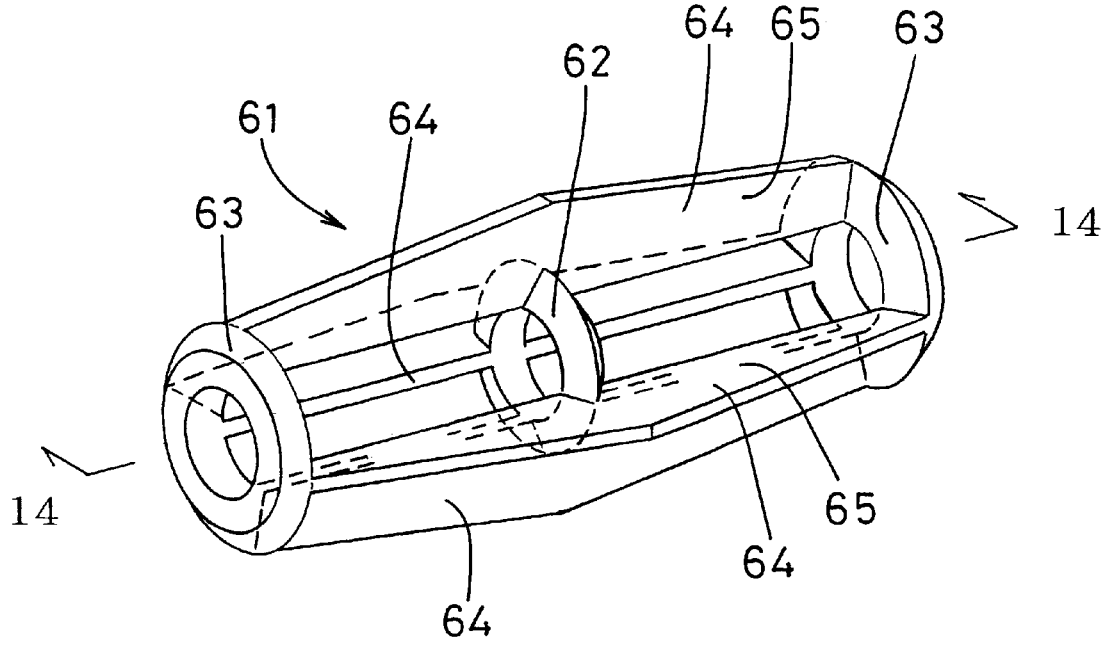
FIG. 13 is a perspective view of the insulating spacer employed in the fourth embodiment.
Figure 14:
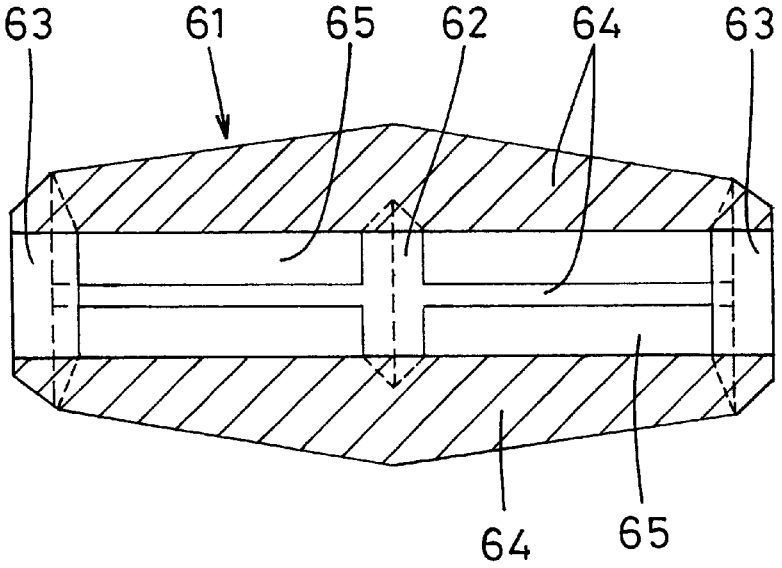
FIG. 14 is a sectional view taken along line 14—14 in FIG. 13.

FIGS. 12 to 15 illustrate a fourth embodiment of the invention. An auxiliary anode element 60 employed in the fourth embodiment comprises the metal wire 21 and a plurality of insulating spacers 61 fitted on the metal wire 21. Each insulating spacer 61 is made of polypropylene (PP) into a shape as shown in FIGS. 13 and 14. More specifically, each insulating spacer 61 comprises an annular central plate 62 through which the metal wire 21 is inserted. An annular end plate 63 is provided at both sides of the central plate 62. Each end plate 63 has a slightly smaller outer diameter than the central plate 62. Four frame plates 64 are provided to connect between the outer periphery of the central plate 62 and the inner face of each end plate 63. Each frame plate 64 has an outwardly projecting lengthwise central portion. The frame plates 64 are disposed at intervals of 90 degrees. Thus, each insulating spacer 61 is formed into the shape of a barrel with relatively large peripheral openings 65 and the projecting central portion. Each insulating spacer may be made of another non-conductive material such as a ceramic material or polyethylene (PE).

Figure 15:
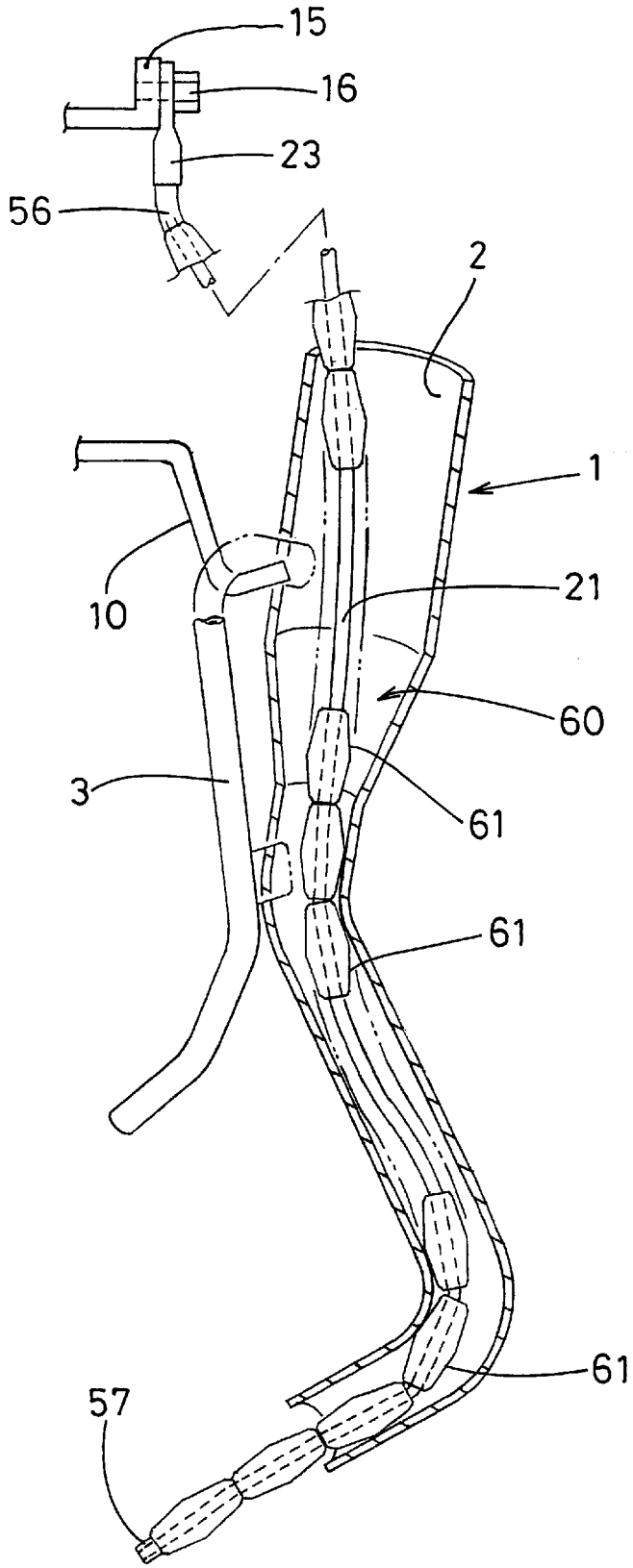
FIG. 15 is a sectional view of the filler pipe into which the auxiliary anode element is inserted, in the fourth embodiment.

The cylindrical cushion member 56 has elasticity and is fitted on the proximal end of the metal wire 21. Thereafter, the plurality of insulating spacers 61 are sequentially fitted with the metal wire 21. The stopper 57 is finally fastened to the distal end of the metal wire 21 in order to prevent the insulating spacers 61 from falling off. Thus, the auxiliary anode element 60 is constituted including the insulating spacers 61 continuously fitted with the metal wire 21 as shown in FIG. 12. When the auxiliary anode element 60 is inserted into the filler pipe 1, the metal wire 21 is suitably curved between the insulating spacers 61 so as to be bent according to the bent form of the filler pipe 1, as shown in FIG. 15. The frame plates 64 of insulating spacers 61 are partially brought into contact with the inner surface of the filler pipe 1 and accordingly, the metal wire 21 is prevented from a directly contacting the inner surface of the filler pipe 1.

According to the fourth embodiment, the current flow distribution in the hollow interior of the filler pipe 1 is improved as in the first embodiment. Consequently, a sufficient coating thickness by the galvanization process can be obtained. Furthermore, the inner surface of the filler pipe 1 can also be galvanized sufficiently without non-plated portions due to the contact of the metal wire 21 with the inner surface of the filler pipe 1.

Although the invention has been applied to the galvanization of a filler pipe in the foregoing embodiments, the invention may also be applied to the plating of other bent or curved pipes or tubes. Furthermore, the invention may be applied to various methods of electroplating other than the galvanization process.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. An auxiliary anode element which can be inserted into a bent tubular workpiece for electroplating an inner peripheral surface of the workpiece, said auxiliary anode element comprising:

a flexible metal wire connectable to a primary anode element, said flexible metal wire comprising a strand of thin stainless steel wires and a connecting terminal on a first end of said strand of thin stainless steel wires; and a spacer, attached to said metal wire, for preventing said metal wire from contacting the inner peripheral surface of the workpiece, said spacer being formed of an insulating material.

2. An auxiliary anode element as claimed in claim 1, wherein said spacer comprises a tube having a plurality of liquid penetrating holes, said tube surrounding said flexible metal wire.

3. An auxiliary anode element as claimed in claim 1, wherein said spacer comprises a helical coil.

4. An auxiliary anode element as claimed in claim 1, further comprising a plurality of said spacers, wherein each of said spacers is formed of plastic and includes a plurality of annular plates secured on a periphery of said metal wire and a plurality of framed plates formed integrally with said annular plates so as to extend axially with respect to said metal wire to thereby connect said annular plates together.

5. An auxiliary anode element as claimed in claim 4, wherein said annular plates of each said spacer comprise a first annular plate disposed at a first axial end of said spacer, a second annular plate disposed at a second axial end of said spacer, and a third annular plate disposed at a center of said spacer, said third annular plate having a diameter which is larger than a diameter of said first and second annular plates.

6. An auxiliary anode element as claimed in claim 1, further comprising a cylindrical member secured on a second end of said strand to hold together said stainless steel wires.

7. An auxiliary anode element capable of insertion into a tubular workpiece for electroplating an inner peripheral surface of the workpiece, said auxiliary anode element comprising:

a spacer tube formed of an insulating material and having a plurality of liquid penetrating openings; and a flexible metal wire inserted in said spacer tube, said flexible metal wire being connectable to a primary anode element, wherein said spacer tube prevents said metal wire from contacting the inner peripheral surface of the workpiece.

8. An auxiliary anode element which can be inserted into a tubular workpiece for electroplating an inner peripheral surface of the workpiece, said auxiliary anode element comprising:

a flexible metal wire connectable to a primary anode element; and a plurality of plastic spacers attached to said metal wire for preventing said metal wire from contacting the inner surface of the workpiece, each of said spacers including a plurality of annular plates secured to a periphery of said metal wire and a plurality of framed plates formed integrally with said annular plates so as to extend axially with respect to said metal wire to thereby connect said annular plates together.

9. An auxiliary anode element as claimed in claim 8, wherein said annular plates of each said spacer comprise a first annular plate disposed at a first axial end of said spacer, a second annular plate disposed at a second axial end of said spacer, and a third annular plate disposed at a center of said spacer, and said third annular plate has a diameter which is larger than a diameter of said first and second annular plates.

* * * * *

US006103076C1

(12) EX PARTE REEXAMINATION CERTIFICATE (5649th)

United States Patent

Mizuno

(10) Number: US 6,103,076 C1

(45) Certificate Issued: Jan. 9, 2007

(54) AUXILLIARY ANODE ELEMENT SUITABLE FOR USE IN ELECTROPLATING A BENT TUBULAR WORKPIECE

(75) Inventor: Chikanori Mizuno, Nagoya (JP)

(73) Assignee: Daiwa Excel Co., Ltd., Aichi (JP)

Reexamination Request:
No. 90/007,206, Sep. 16, 2004

Reexamination Certificate for:

| | |
|---|---|
| Patent No.: | **6,103,076** |
| Issued: | **Aug. 15, 2000** |
| Appl. No.: | **09/066,680** |
| Filed: | **Apr. 28, 1998** |

(30) Foreign Application Priority Data

Apr. 30, 1997 (JP) ..... 9-112911

(51) Int. Cl.
*C25D 17/12* (2006.01)

(52) U.S. Cl. ..... 204/286.1; 204/272; 204/280; 204/288; 205/131

(58) Field of Classification Search ..... None
See application file for complete search history.

(56) References Cited

U.S. PATENT DOCUMENTS

| | | | | |
|---|---|---|---|---|
| 3,104,220 | A | * 9/1963 | Preiser | 204/196.33 |
| 4,302,316 | A | * 11/1981 | Nester | 204/224 R |
| 4,367,127 | A | * 1/1983 | Messing et al. | 205/566 |
| 5,394,768 | A | * 3/1995 | Hallock, III | 74/502.5 |

FOREIGN PATENT DOCUMENTS

| | | |
|---|---|---|
| JP | 36-16704 | 9/1961 |
| JP | 38-20439 | 10/1963 |
| JP | 43-006848 | 3/1968 |
| JP | 60-000370 | 1/1985 |
| JP | 60-162799 | 8/1985 |
| JP | 2-102468 | 8/1990 |

* cited by examiner

*Primary Examiner*—Kiley Stoner

(57) ABSTRACT

A flexible auxiliary anode element for electroplating a tubular workpiece while the workpiece and an anode element are immersed in a plating liquid contained in a plating both. The flexible auxiliary anode element can be inserted into a hollow interior of the workpiece so that a metal wire of the auxiliary anode element is insulated from an inner peripheral surface of the workpiece by an insulating spacer.

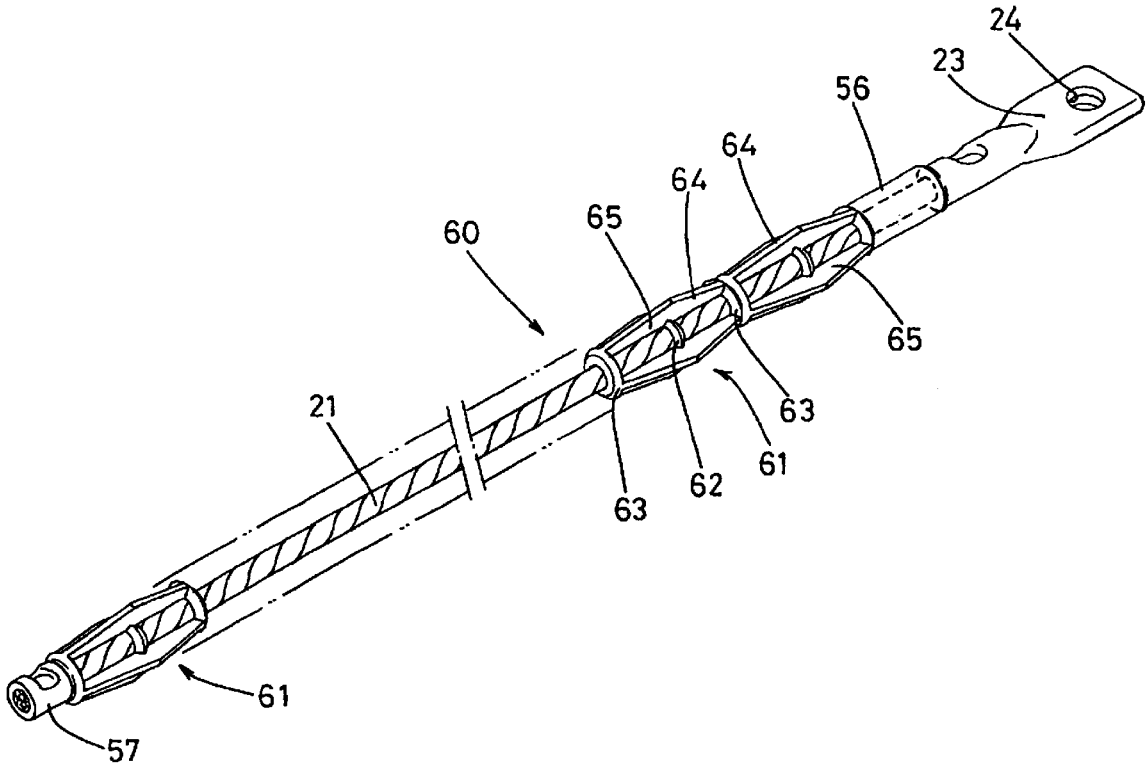

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 8 and 9 is confirmed.

Claims 1–3 and 6–7 are cancelled.

Claim 4 is determined to be patentable as amended.

Claim 5, dependent on an amended claim, is determined to be patentable.

4. An auxiliary anode element [as claimed in claim 1, further comprising a plurality of said spacers,] *which can be inserted into a bent tubular workpiece for electroplating an inner peripheral surface of the workpiece, said auxiliary anode element comprising:*

*a flexible metal wire connectable to a primary anode element, said flexible metal wire comprising a strand of thin stainless steel wires and a connecting terminal on a first end of said strand of thin stainless wires; and*

*a plurality of spacers, attached to said metal wire, for preventing said metal wire from contacting the inner peripheral surface of the workpiece,* wherein each of said spacers is formed of plastic *insulating material* and includes a plurality of annular plates secured on a periphery of said metal wire and a plurality of framed plates formed integrally with said annular plates so as to extend axially with respect to said metal wire to thereby connect said annular plates together.

* * * * *